US005484232A

United States Patent [19]

Hayashi et al.

[11] Patent Number: 5,484,232

[45] Date of Patent: Jan. 16, 1996

[54] METHOD FOR INJECTING LUBRICANT AND FILLER IN THE PIPE-JACKING METHOD

[75] Inventors: Mitsutoshi Hayashi, Ohmiya; Akitaka Fujita, Tokyo; Shingo Nagashina, Tokyo; Minoru Kurashina, Tokyo; Makoto Kajiyama, Zama; Hideki Uno, Tokorozawa, all of Japan

[73] Assignees: Tokyo Gas Company Ltd.; Kabushiki Kaisha Iseki Kaihatsu Koki, both of Tokyo, Japan

[21] Appl. No.: 196,443

[22] Filed: Feb. 15, 1994

[30] Foreign Application Priority Data

| | | | |
|---|---|---|---|
| Mar. 3, 1993 | [JP] | Japan | 5-065945 |
| Mar. 22, 1993 | [JP] | Japan | 5-085114 |
| Nov. 9, 1993 | [JP] | Japan | 5-279296 |

[51] Int. Cl.[6] ..... F16L 1/00

[52] U.S. Cl. ..... 405/184; 405/154

[58] Field of Search ..... 405/154, 184, 405/156, 146, 141, 138; 138/98

[56] References Cited

U.S. PATENT DOCUMENTS

| | | | |
|---|---|---|---|
| 4,176,985 | 12/1979 | Cherrington | 405/154 X |
| 4,576,515 | 3/1986 | Morimoto et al. | 405/184 |
| 4,925,344 | 5/1990 | Peres | 405/184 |
| 5,063,967 | 11/1991 | Stephens | 138/98 |
| 5,096,000 | 3/1992 | Hesse | 405/184 X |
| 5,205,671 | 4/1993 | Handford | 405/154 |
| 5,241,993 | 9/1993 | Stephens | 138/98 |

*Primary Examiner*—Dennis L. Taylor
*Attorney, Agent, or Firm*—Townsend & Banta

[57] ABSTRACT

When laying a conduit comprised of double-wall pipes A, each of which comprises inner pipe 1 and outer pipe 2, the smooth propulsion of double-wall pipes is possible by injecting lubricant into a space between the outside of double-wall pipes and the ground on a scheduled line along which conduit B to be laid is divided into section, each having a given length based upon the distance over which the effect of the lubricant can be maintained. Lubricant is injected from the double-wall pipes which is to be positioned at the heads in the respective sections 1 to n of supply pipes 3 which are provided between inner pipe 1 and outer pipe 2 of double-wall pipe A. Supply pipes of double-wall pipe A which has been propelled are connected with supply pipes of a new double-wall pipe, wherein the number of supply pipes connected with each other is determined for the respective sections. Lubricant is supplied from the upstream side and from the downstream side of the propelling direction to double-wall pipes. After conduit B has been laid, back-filling material as a filler is supplied to supply pipes 3 so that a space formed between the outside of double-wall pipes 23 and the ground is filled with filler. Sheath pipes 23 are provided between inner pipes 1 and outer pipes 2. After conduit B has been laid, back-filling material, as inside-filling material, is supplied to sheath pipes 23 so that a space between the outside of double-wall pipes and the ground is filled with inside-filling material.

13 Claims, 12 Drawing Sheets

METHOD FOR INJECTING LUBRICANT AND FILLER IN THE PIPE-JACKING METHOD

BACKGROUND OF THE INVENTION

1. Field of the Invention

The present invention relates to a method of injecting lubricant into a space between the outside of double-wall pipes and the ground and laying a conduit comprised of double-wall pipes each of which comprises an inner pipe and an outer pipe by propelling the double-wall pipes, and to a method of injecting filler into a space formed between inner pipes and outer pipes, after the conduit has been laid.

2. Description of the Prior Art

Laying sewer conduit or service water conduit in the ground is carried out by tunneling through the ground by a tunneling machine, while the tunneling machine followed by pipes such as Hume pipes and steel pipes are propelled by a pipe-jacking machine, wherein it is carried out to inject lubricant into a space between the outside of the tunneling machine and the ground and between the outside of pipes and the ground. Further, in the above-mentioned pipe-jacking method; it is also carried out to inject back-filling material into a space between the outside of pipes forming a conduit and the ground, after having laid the conduit.

Each pipe, with diameters over 800mm, used in the above-mentioned pipe-jacking method is formed with a hole at a given position. The hole is connected through a hose with a lubricant or a back-filling material feeder, which is provided on the ground. While propelling the pipes, lubricant is injected into a space between the outside of the pipes and the ground, by supplying lubricant through the hose to the hole and injecting lubricant to into the space through the hole so that frictional force can be decreased, or after having laid a desired conduit in the ground, back-filling material is injected into a space between the outside of the pipes and the ground so that the space between the outside of the pipes and the ground is filled with back-filling material.

On the other hand, there are cases where a conduit for supplying gas such as coal gas or fuel and natural gas and others is laid in the ground. Since a gas pipe requires the highest gas tightness, gas pipes are connected to each other by mutually welding the edges of pipes, wherein the weld is inspected by non-destructive inspection to form a conduit for supplying gas without welding defects is formed.

Since a gas pipe requires the highest gas tightness, it is thought that a gas pipe cannot be provided with a hole for injecting lubricant or back-filling material into a space between the outside of the pipes and the ground. Further, it is thought that the edge of a gas pipe cannot be brought into immediate contact with a push ring of a pipe-jacking machine so that gas pipes cannot be propelled by a pipe-jacking machine, because there is the possibility that the edge of the gas pipe will be damaged by the push ring.

Since there are the above-mentioned problems, when laying a conduit for gas, a conduit comprised of Hume pipes with the diameter sufficiently larger than the outside of the gas pipe is first laid by the pipe-jacking method, and a space between the outside of the conduit comprised of Hume pipes and the ground is filled with back-filling material, then a conduit for gas supply comprised of the gas pipes is formed within the conduit comprised of Hume pipes.

Recently, it was developed that double-wall pipes each of which is composed of an outer pipe and an inner pipe inserted into the outer pipes are prefabricated, and thrust is applied to the outer pipes from a pipe-jacking machine so that the inner pipes and the outer pipes can be simultaneously propelled. In this pipe-jacking method, every time an individual double-wall pipe is propelled into the ground, the edge of an inner pipe of the individual double-wall pipe which has been propelled into the ground is welded with the edge of new a individual double-wall pipe which is disposed in a start vertical shaft so that a conduit comprised of inner pipes with the highest gas tightness can be laid by one pipe-jacking method.

BRIEF SUMMARY OF THE INVENTION

It is an object of the present invention to provide a method of injecting lubricant into a space between the outside of double-wall pipes and the ground while propelling double-wall pipes, and to provide a method of injecting lubricant from plural double-wall pipes into a space between the outside of a double-wall pipe and the ground while propelling double-wall pipes, particularly, in cases where the length of conduit which is to be laid is increased.

It is a second object of the present invention to provide a method of injecting lubricant effectively into a space between the outside of double-wall pipes and the ground wherein the diameter of supply pipes can be reduced without the number of supply pipes provided between the inner pipes and outer pipes being increased.

It is a third object of the present invention to provide a method of injecting filler into a space between the outside of double-wall pipes and the ground after a conduit has been laid.

It is a fourth object of the present invention to provide a method of injecting filler into a space formed between inner pipes and outer pipes of double-wall pipes.

In order to achieve the first objective, the present invention is characterized in that a tunneling machine and double-wall pipes which are provided with at least one supply pipe between inner pipes and outer pipes and with a discharge port for injecting lubricant into the outside of double-wall pipes following the tunneling machine are propelled from a start vertical shaft and toward an arrival vertical shaft by a pipe-jacking machine and after the double-wall pipe has been propelled, supply pipes of the double-wall pipe which have been propelled are connected with supply pipes of a new double-wall pipe, and supply pipes of the new double-wall pipe are connected to a lubricant feeder. Therefore, the first double-wall pipe and the new double-wall pipe are propelled by the pipe-jacking machine, while lubricant is supplied from the lubricant feeder to double-wall pipe and injected through the discharge port into a space between the outside of the double-wall pipes and the ground.

According to the present invention, double-wall pipes can be smoothly propelled by reducing frictional force between the outside of double-wall pipes and the ground by injecting lubricant into a space between the outside of double-wall pipes and the ground.

Particularly, various kinds of double-wall pipes provided with a different number of supply pipes between the inner pipe and the outer pipes are prepared, and a scheduled line along which a conduit is to be laid is divided into sections each having a given length. Double-wall pipes provided with the smallest number of supply pipes, are chosen against the farthest section from the start vertical shaft, double-wall pipes provided with supply pipes the number of which is at least one more than the smallest number are chosen against a section adjacent to the farthest section from the start vertical shaft on the start vertical shaft side, and so forth. Double-wall pipes provided with supply pipes which are increased in number by at least one more than the number of supply pipes of double-wall pipes chosen against the section adjacent to the farthest section from the start vertical shaft on the start vertical shaft in order and in the direction of the arrival of the vertical shaft to the start vertical shaft are chosen against the respective sections. The chosen double-wall pipes are arranged by increasing the number of supply pipes in the direction of from the arrival vertical direction to the start vertical shaft, wherein lubricant can be injected from plural double-wall pipes into a space between the outside of double-wall pipes and the ground without the length of a conduit which is to be laid being influenced.

Namely, even if the property of lubricant for lowering frictional resistance between the outside of double-wall pipes and the ground is worsened by subterranean water, earth and soil which is mixed with lubricant, frictional resistance can be reduced by a lubricant which is injected from other positions.

Accordingly, even in cases where a long conduit is laid, double-wall pipes can be propelled smoothly without the thrust of the double-wall pipes being increased.

In order to achieve the second objective, the present invention is characterized in that a scheduled line along which a conduit is to be laid is divided into two zones, and while double-wall pipes which are to be positioned on the arrival vertical shaft side of the center of the conduit are propelled, lubricant is injected through supply pipes of the head double-wall pipes following a tunneling machine into a space between the outside of double-wall pipes and the ground, and while double-wall pipes which are to be positioned on the start vertical shaft side of the center of the conduit are propelled, lubricant is injected through supply pipes of the rearmost double-wall pipe of double-wall pipes following the tunneling machine into a space between the outside of double-wall pipes and the ground.

Particularly, various kinds of double-wall pipes provided with a different number of supply pipes between inner pipes and outer pipes are prepared, and a scheduled line along which a conduit is to be laid is divided into sections each having a given length. Double-wall pipes provided with the smallest number of double-wall pipes are chosen against the central section of the scheduled line, and double-wall pipes provided with supply pipes the number of which is a least one more than the smallest number are chosen against a section adjacent to the central section on the arrival vertical shaft side and against a section adjacent to the central section on the start vertical shaft side, and so forth. Double-wall pipes provided with supply pipes which are increased in number by at least one more than the number of supply pipes of double-wall pipes chosen against the section adjacent to the central section on the arrival vertical shaft side in order in the direction of the central section to the arrival vertical shaft and double-wall pipes provided with supply pipes which are increased in number by at least one more than the number of supply pipes of double-wall pipes chosen against the section adjacent to the central section on the start vertical shaft side in order in the direction from the central section to the start vertical shaft are chosen against the respective sections between the central section and the arrival vertical shaft, and against the respective sections between the central section and the start vertical shaft, the chosen double-wall pipes are propelled in the order of decreasing supply pipes in the direction of from the arrival vertical shaft to the central section, then double-wall pipes provided with the smallest number of supply pipes against the central section are propelled. Further the chosen double-wall pipes are propelled in the order of increasing supply pipes, wherein even if the length of the conduit which is to be laid is long, it is not necessary to increase the number of supply pipes an the diameter of the supply pipe can be made small.

Namely, the number of supply pipes in double-wall pipes which are to be positioned in sections between the central section and the arrival vertical shaft can be equal to the number of supply pipes in the double-wall pipes which are to be positioned in sections between the central section and the start vertical shaft. Accordingly, even if the length of the conduit which is to be laid is enlarged, it is not necessary to increase the number of supply pipes in individual double-wall pipes.

Further, while double-wall pipes are propelled, lubricant can be supplied at the same time from the arrival vertical shaft side and from the start vertical shaft side to double-wall pipes and injected into a space between the outside of double-wall pipes and the ground. Accordingly, it is possible to reduce line resistance in a case where lubricant is supplied, thereby, the diameter of the supply pipe can be made small.

In order to achieve the third object, the present invention is characterized in that a conduit comprised of double-wall pipes provided with plural supply pipes between inner pipes and outer pipes and discharge ports in the outer pipes and with which the supply pipes is connected has been laid, and then lubricant is supplied from the start vertical shaft and from the arrival vertical shaft to double-wall pipes and injected into a space between the outside of double-wall pipes and the ground.

According to the above-mentioned invention, it is possible to inject filler into a space between the outside of double-wall pipes and the ground at the same time from the arrival vertical shaft side and from the start vertical shaft side into a space between the outside of double-wall pipes and the ground.

Therefore, the time taken for injection of filler can be shortened thereby reducing the time taken for the injection process.

In order to achieve the fourth object, the present invention is characterized in that within a space formed between an inner pipe and an outer pipe, the sheath pipe opening toward the space is arranged, lubricant is supplied to the inside of the sheath pipe, while a supply pipe with which a discharge port for discharging lubricant to the outside of double-wall pipe is connected is inserted so that the second double-wall pipe is formed. The first double-wall pipes are laid between the start vertical shaft and the arrival vertical shaft, thereafter filler is supplied from the start vertical shaft side and from the arrival vertical shaft side to the sheath pipe so that the space between the inner pipe and the outer pipe is filled with filler which is discharged into the space.

According to the present invention, filler can be supplied from the arrival vertical shaft and from the start vertical shaft to a space between inner pipes and outer pipes, thereby the space can be filled with filler without using the special apparatus.

BRIEF DESCRIPTION OF THE DRAWINGS

FIG. 3(*b*) is a cross-section view taken along line 3(*a*) of the apparatus of FIG. 3(*a*); FIG. 4(*b*) is a cross-sectional view taken along line 4(*d*) of FIG. 4(*a*);

FIG. 5(*b*) is a cross-sectional view taken along line 5(*b*) of the apparatus of FIG. 5(*a*).

FIG. 11(*b*) is a cross-sectional view-taken along line 11(*b*) of the apparatus of FIG. 11(*a*) and FIG. 12 is a view for showing a state where a space formed between an inner pipe and an outer pipe of a double-wall pipe is filled with filler, after having laid a conduit.

DETAILED DESCRIPTION OF THE PREFERRED EMBODIMENT

In a method of injecting lubricant into a space between the outside of double-wall pipes and the ground according to the present invention, lubricant is injected into a space between the outside of double-wall pipes and the ground, easily and surely, while propelling double-wall pipes each of which comprises an inner pipe and an outer pipe in the semi-shield process. Further, after having laid a conduit, a space between the outside of double-wall pipes and the ground is filled with filler as back-filling material, easily and in a short period and a space between an inner pipe and an outer pipe of each double-wall pipe is filled with filler as Inside-filling material, easily and in a short period.

First, a method of injecting lubricant into a space between the outside of double-wall pipes and the ground is explained.

The propelling length, in which lubricant, which is injected into a space between the outside of double-wall pipes and the ground, shows that the lubricant effect when laying conduit B depends upon the nature of the ground, which is nearly constant. Therefore, if new lubricant is injected into a space between the outside of double-wall pipes and the ground while the lubricant effect is maintained, double-wall pipes A can always be propelled at a state in which a frictional resistance between the outside of double-wall pipes and the ground is reduced.

Namely, it is possible to maintain the lubricant effect of lubricant by injecting lubricant from the head double A connected with a tunneling machine and injecting new lubricant from a double-wall pipe A which is arranged behind the double-wall pipe at a distance from the head double-wall pipe in which the lubricant effect of lubricant injected into a space between the outside of double-wall pipes and the ground is shown or less into a space between the outside of double-wall pipes and the ground.

Figure 1:
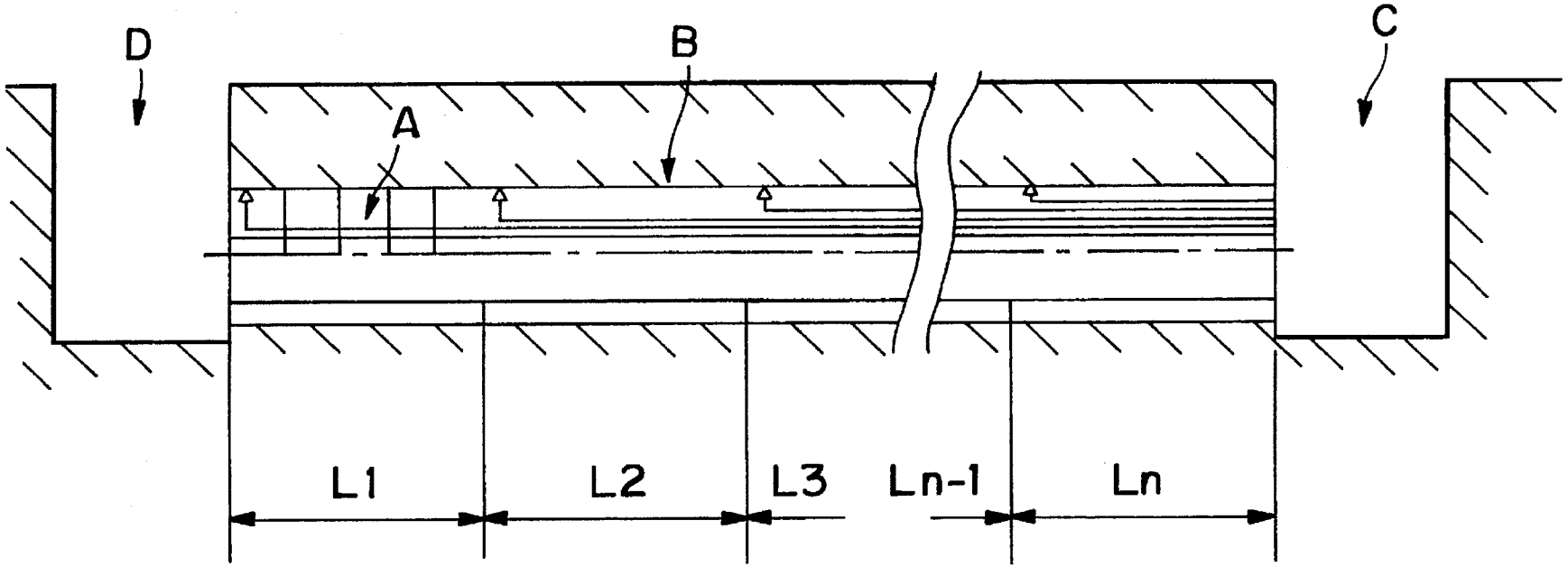
FIG. 1 is a view for showing a state where a conduit to be laid is divided into sections with a given length.

Therefore, as shown in FIG. 1, a scheduled pipe of the conduit B to be laid between a start vertical shaft C and an arrival vertical shaft D is divided into sections L1 to Ln each of which has a length in which lubricant shows the lubricant effect or less and which is equal to integral multiples of double-wall pipes. In the present embodiment, a length of section is set to 60 m, wherein ten double-wall pipes are included in one section.

Figure 2:
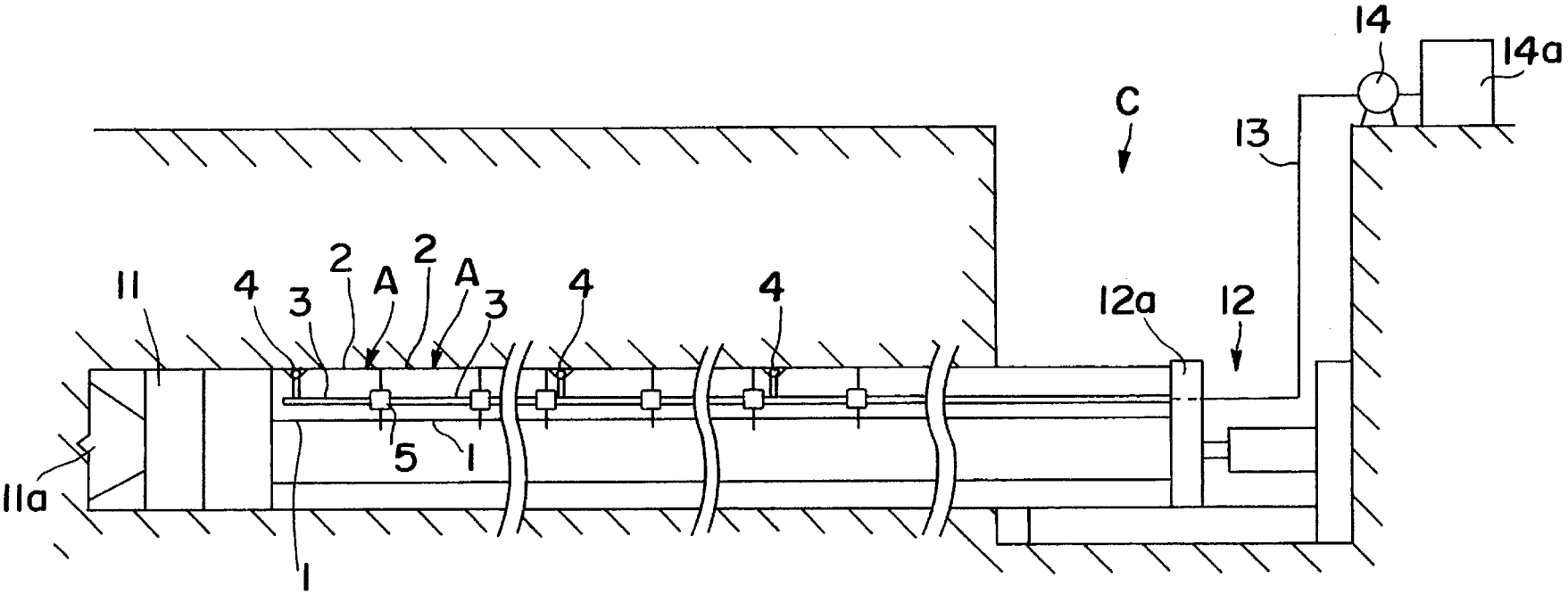
FIG. 2 is a state for showing a state where lubricant is injected into a space between the outside of double-wall pipes and the ground.

As shown in FIG. 2, double-wall pipe A comprises inner pipe 1 and outer pipe 2. Supply pipe 3 for lubricant is provided between inner pipe 1 and outer pipe 2. Inner pipe 1 and outer pipe 2 are made of steel pipes with preset diameters, respectively. Inner pipe 1 of double-wall pipe A which has been propelled is welded to inner pipe 1 of new double-wall pipe A over the whole circumference, while supply pipe 3 of the double-wall pipe A which has been propelled is connected with supply pipe 3 of the new double-wall pipe A through joint 5.

Check valve 4 is provided at an end of outer pipe 2. Check valve 4 is connected with supply pipe 3. Check valve 4 allows lubricant to flow out of outer pipe 2 into a space formed between the outside of outer pipes 2 and the ground, but prevents earth and soil and subterranean water from entering into the inside of double-wall pipe A. Further, supply pipe 3 is secured to a place between inner pipe 1 and outer pipe 2.

Accordingly, lubricant can be sent to check valve 4 through supply pipe 3 by closing end of an supply pipe 3 and connecting the other end thereof with pump 14 for forcing lubricant, and injected through check valve 4 into a space between the outside of double-wall pipes A and the ground. Every time double-wall pipes are propelled by the length of each section, supply pipe 3 is connected with check valve 4 so that lubricant can be injected from the forefront double-wall pipe A in each section into a space between the outside of double-wall pipes and the ground.

In an embodiment shown in FIG. 2, an end of supply pipe 3 is closed on a side down stream in the propelling direction, and lubricant is supplied from a side upper stream in the propelling direction to supply pipe 3. Lubricant may be supplied from a side upper stream in the propelling direction in a case where the length of the conduit B is short. As above-mentioned, lubricant can be injected into a space between the outside of double-wall pipes and the ground simultaneously from plural check valves which are connected with one supply pipe. However, when the length of the conduit B is long and the number of sections L is numerous, many check valves 4 are connected with supply pipe 3. Therefore, it is difficult to inject lubricant from check valve 4 positioned at the most downstream side into a space between the outside of double-wall pipes and the ground.

Accordingly, it is preferable to provide plural supply pipes 3 in parallel with each other between inner pipes 1 and outer pipes 2, and to connect individual supply pipe 3 with a check valve 4 corresponding to the individual supply pipe 3. However, when manufacturing double-wall pipes, the number of supply pipes 3 which are provided between inner pipes and outer pipes should be not restricted.

Namely, when the number of sections in conduit B is preset, and the length of double-wall pipes A is preset, the number of double-wall pipes A are determined. Accordingly, the manufacturing process of double-wall pipes, double-wall pipes A corresponding to section L1 which is the farthest section from a start vertical shaft are provided with one supply pipe 3, respectively, double-wall pipes A corresponding to section L2 which is a section next to section L2 with two supply pipes, respectively, and in the same way, double-wall pipes A corresponding to section Ln are provided with n supply pipes 3, and when laying a conduit B, double-wall pipes can be propelled, while double-wall pipes corresponding to each section are selected.

Further, every double-wall pipe A may be provided with n supply pipes 3 according to "n" of sections of the conduit, wherein when propelling double-wall pipes A, the number of used supply pipes 3 of double-wall pipes is selected for individual section L (1 to n).

Figure 3A:
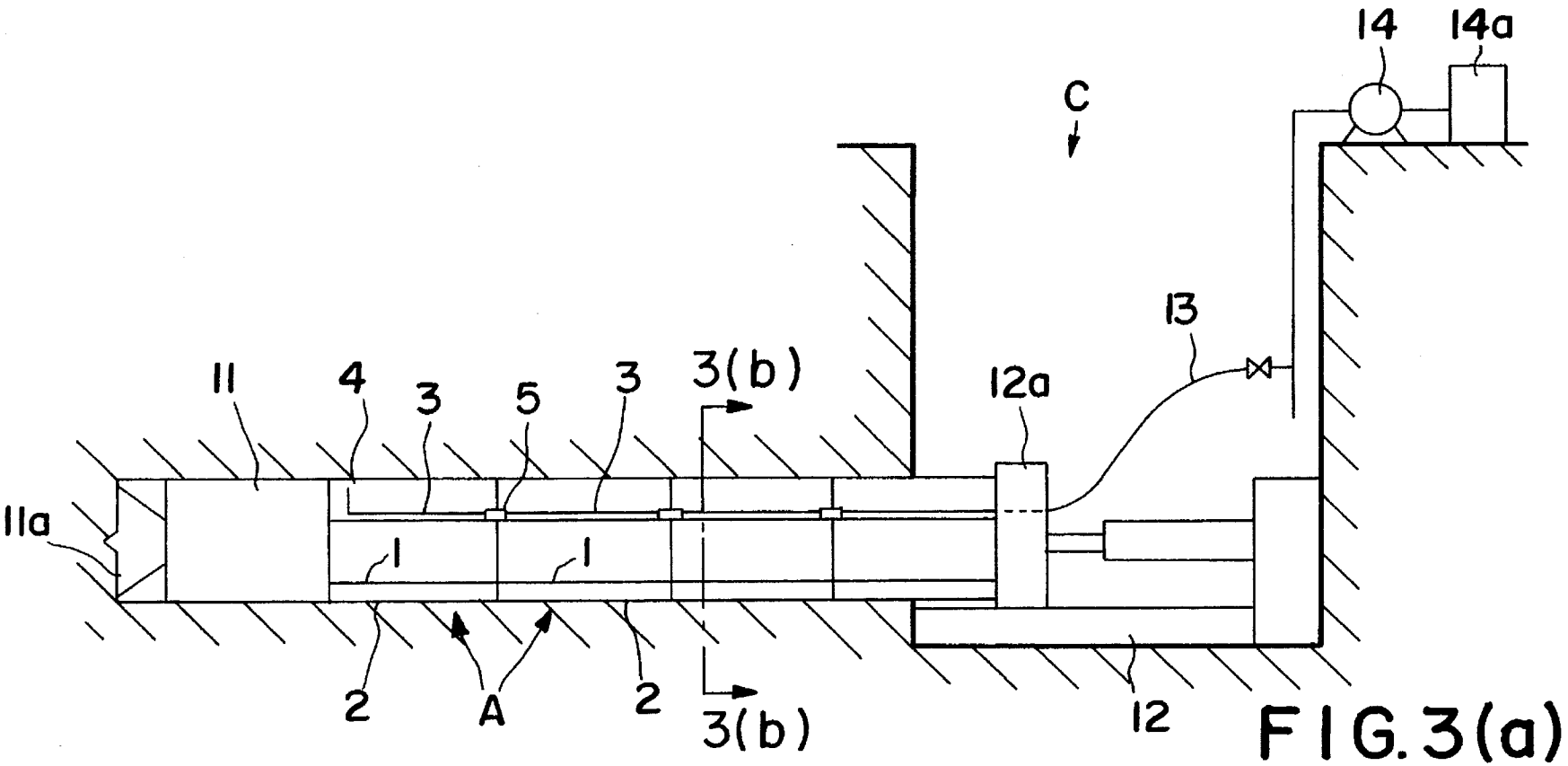
FIG. 3(*a*) is a view for showing a state where lubricant is supplied from a side of the upper stream in the propelling direction to a double-wall pipe to be positioned in a section which is the farthest from a start vertical shaft, during the propulsion of double-wall pipes.
Figure 3B:
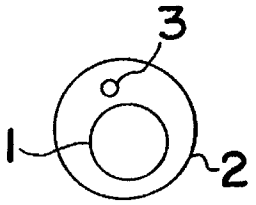

Then, referring to FIGS. 3 to 5, a method of supplying lubricant from a side of upper stream in the propelling direction of double-wall pipes A to double-wall pipe A, when laying conduit B by propelling double-wall pipes A from a start vertical shaft toward arrival vertical shaft D is explained.

In the propelling process, tunneling machine 11 is arranged at the head. The ground is excavated by cutter head 11*a* of tunneling machine 11, while tunneling machine 11 is propelled by pipe-jacking machine 12.

After tunneling machine 11 has been propelled, a first double-wall pipe A being a component of the conduit B is connected with tunneling machine 11. The double-wall pipe A corresponds to section L1 which is the farthest section from the start vertical section C. Therefore, check valve 4 provided in the double-wall pipe A is connected with supply pipe 3, and pump 14 is connected with supply pipe 3 through hose 13, so that lubricant in tank 14*a* is supplied by pump 14 through hose 13 and supply pipe 3 to check valve 4, and injected through check valve 4 into a space between the outside of double-wall pipes A and the ground, while propelling the first double-wall pipe, by which frictional resistance between double-wall pipes A and the ground is reduced so that double-wall pipes can be smoothly propelled.

After the first double-wall pipe A has been propelled, push ring 12*a* of pipe-jacking machine 12 is backtracked. Thereafter hose 13 is disconnected from supply pipe 3 of the first double-wall pipe A. Then, a second double-wall pipe A is disposed on pipe-jacking machine 12, and an end of the second double-wall pipe A is brought into contact with and welded to an end of the first double-wall pipe A, while supply pipe 3 of the first double-wall pipe is connected through joint 5 with supply pipe 3 of the second double-wall pipe A. Then, after supply pipe 3 of the second double-wall pipe A has been connected with hose 13, push ring 12*a* is brought into the second double-wall pipe A and the second double-wall pipe A can be propelled by push ring 12*a*, wherein lubricant is injected through only check valve 4 of the first double-wall pipe into a space between the outside of double-wall pipe and the ground(FIG. 3*a*).

As above-mentioned, double-wall pipes A corresponding to section L1 are connected with each other in order, until the length of double-wall pipes connected with each other reaches to the length of section L1. After the propulsion of the double-wall pipe corresponding to the backward end of section L1 has been finished, double-wall pipe having the function as double-wall pipe A corresponding to the forward end of section L2 is disposed on pipe-jacking machine 12.

Figure 4A:
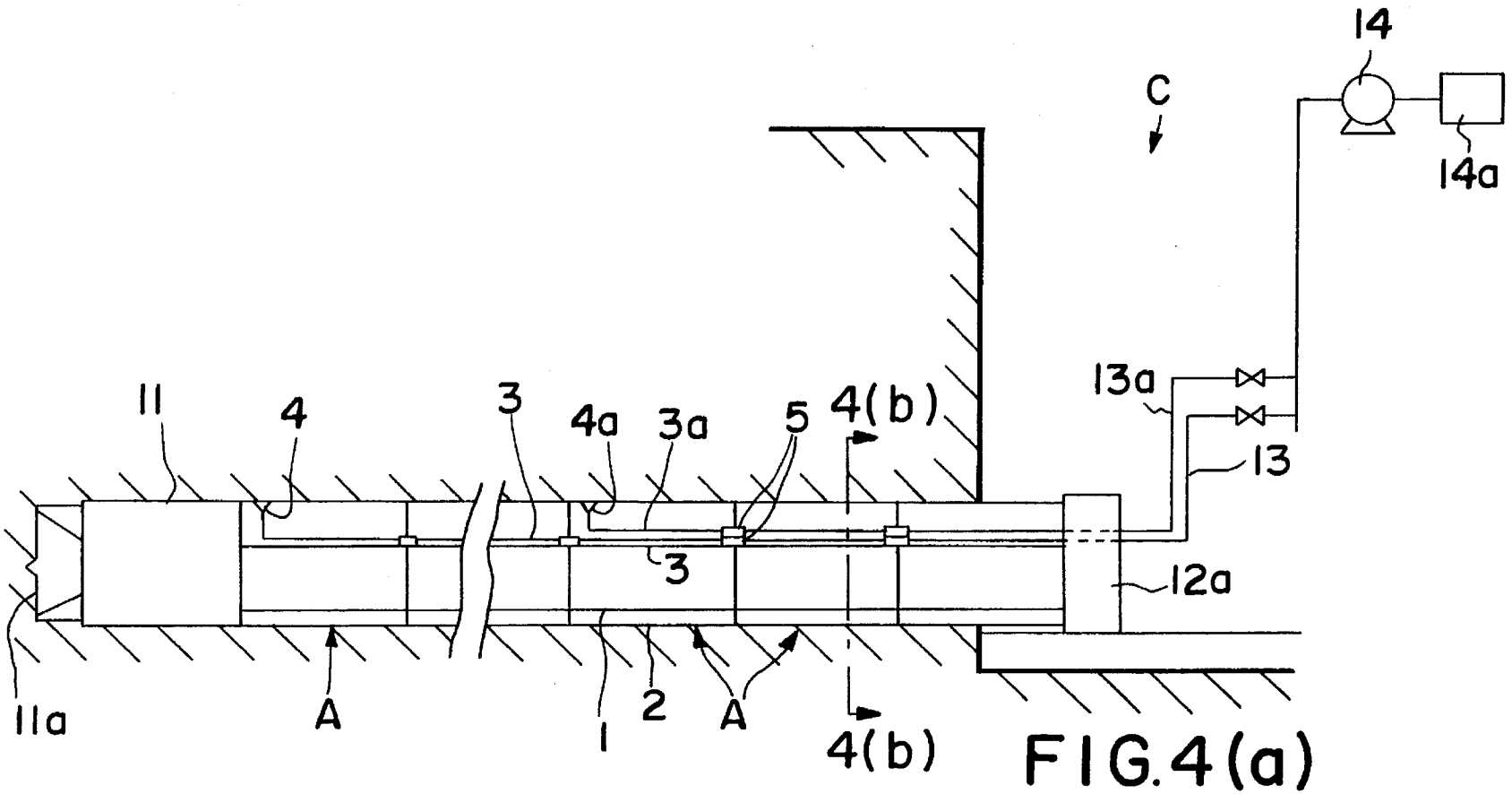
FIG. 4(*a*) is a view for showing a state where lubricant is supplied from a side of the upper stream in the propelling direction to a double-wail pipe to be positioned in a second section next to the section which is the farthest from the start vertical shaft,during the propulsion of double-wall pipes.
Figure 4B:
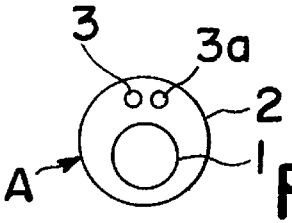

Namely, supply pipe 3 of the double-wall pipe A corresponding to the backward end of section L1 which has been propelled is connected with supply pipe 3 of the double-wall pipe A corresponding to the head of section L2, while supply pipe 3 (3*a*) is connected also to check valve 4(4*a*), wherein lubricant is injected from the double-wall pipe A corresponding to the head of section L1 and from the double-wall pipe A corresponding to the head of section L2, simultaneously into a space between the outside of double-wall pipes and the ground by which frictional resistance between the outside of double-wall pipes and the ground can be reduced so that double-wall pipes A can be smoothly propelled(FIGS. 4*a*and 4*b*).

As above-mentioned, the double-wall pipes A corresponding to sections L1 to Ln-1 are propelled. After the propulsion of double-wall pipe A corresponding to the backward end of section Ln-1 has been finished, double-wall pipe A having the function as the double-wall pipe A corresponding to the head of section Ln is disposed on pipe-jacking machine 12, in the same manner.

Figure 5A:
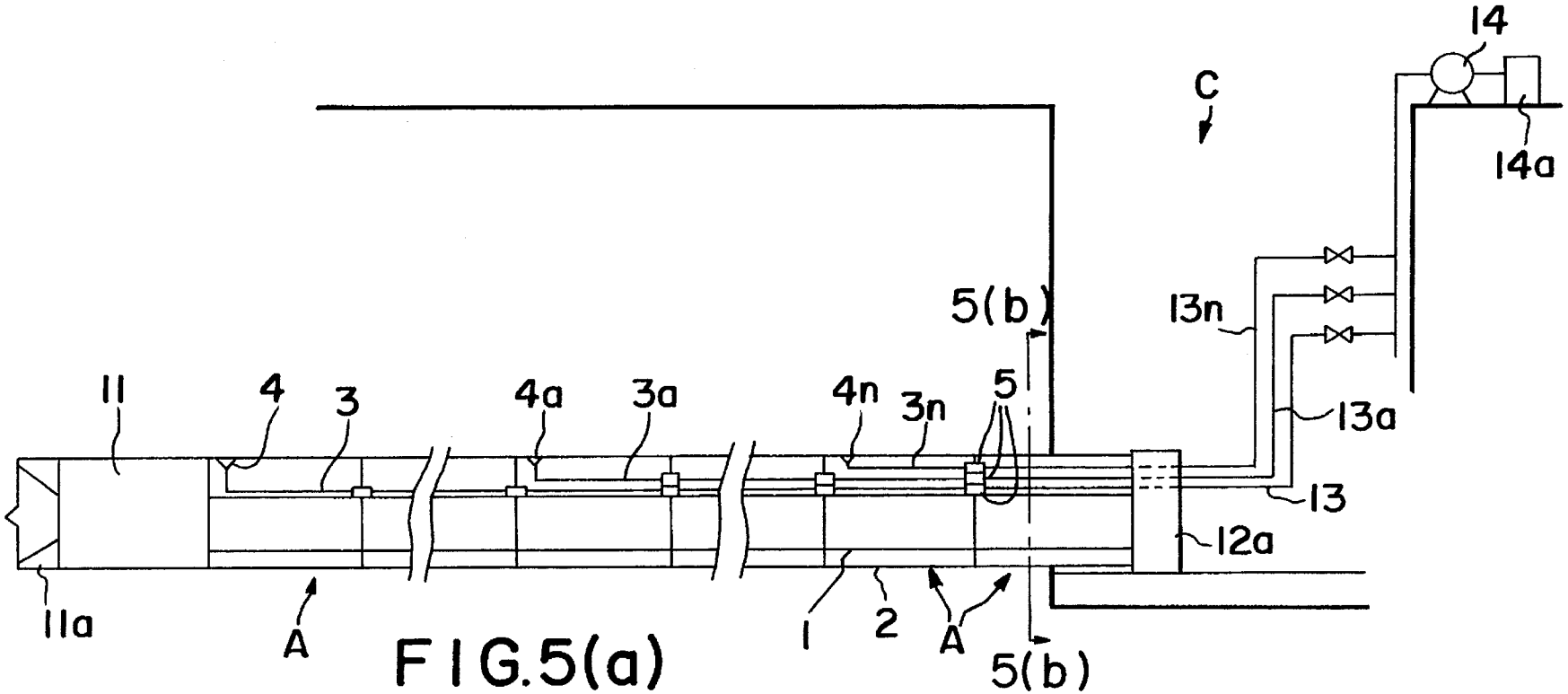
FIG. 5(*a*) is a view for showing a state where lubricant is supplied from a side of the upper stream to be positioned in the propelling direction to a double-wall pipe in a third section next to the second section.
Figure 5B:
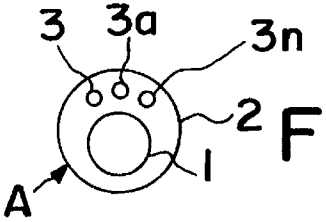

Namely, supply pipes 3 to 3*n* -1 of the double-wall pipe A corresponding to the backward end of section Ln-1 which has been propelled are connected with supply pipes 3 to 3*n* -1 of the double-wall pipe A corresponding to the head of section Ln, while supply pipe 3(3*n*) of the double-wall pipe A is connected also to check valve 4(4*a*). Then, hoses 13 to 13*n* are connected with n supply pipes 3 to 3*n*-1 . Thereafter pump 14 is driven so that lubricant is supplied to supply pipes 3 to 3*n* -1, while propelling double-wall pipes 3 to 3*n* by pipe-jacking machine 12, wherein lubricant is injected from the double-wall pipe A corresponding to the head of each section L1 to Ln, simultaneously into a space between the outside of double-wall pipes and the ground by which frictional resistance between the outside of double-wall pipes and the ground can be reduced so that double-wall pipes can be smoothly propelled(FIGS. 5*a*and 5*b*).

As above-mentioned, in the present embodiment, when lubricant is injected into a space between the ground of double-wall pipes A and the ground, hose 13 connected with pump 14 is connected with supply pipe 3 provided in double-wall pipe A, then pump 14 is driven during the propulsion of double-wall pipes A, by which it is made possible to inject lubricant through hose 13, supply pump 3, as check valve 4 into a space between the outside of double-wall pipes and the ground. Therefore, lubricant injecting operation is facilitated, and it is possible to smoothly propel double-wall pipes.

In the present invention, there is shown a case where different kinds of double-wall pipes, such as the double-wall pipes A corresponding to section L1 each of which is provided with one supply pipe 3, and the double-wall pipes A corresponding to section Ln each of which is provided with n supply pipes, are used. However, it is possible to lay conduit B using the double-wall pipes A each of which is previously provided with n supply pipes, wherein a supply pipe 3(the number thereof: n-1 to 1) which is unused in the double-wall pipes A corresponding to each section L1 to Ln-1 are closed by a plug so that lubricant can be supplied to a desired section without being supplied to sections positioned on aside of upper stream with regard to the desired section.

Figure 6:
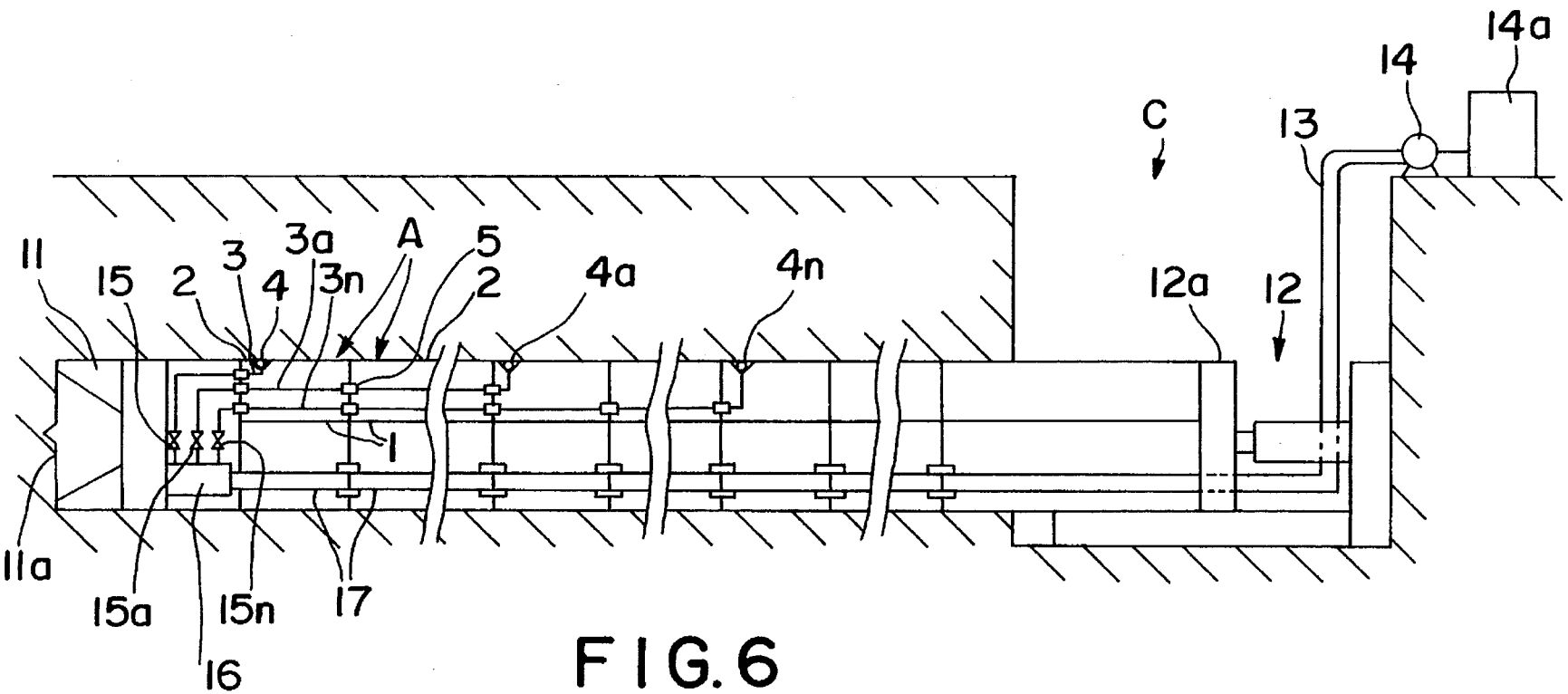
FIG. 6 is a view for showing a state where lubricant is supplied from a side of the down stream to a double-wall pipe to be positioned in a section which is the farthest from the start vertical shaft and the ground, during the propulsion of double-wall pipes.
Figure 7:
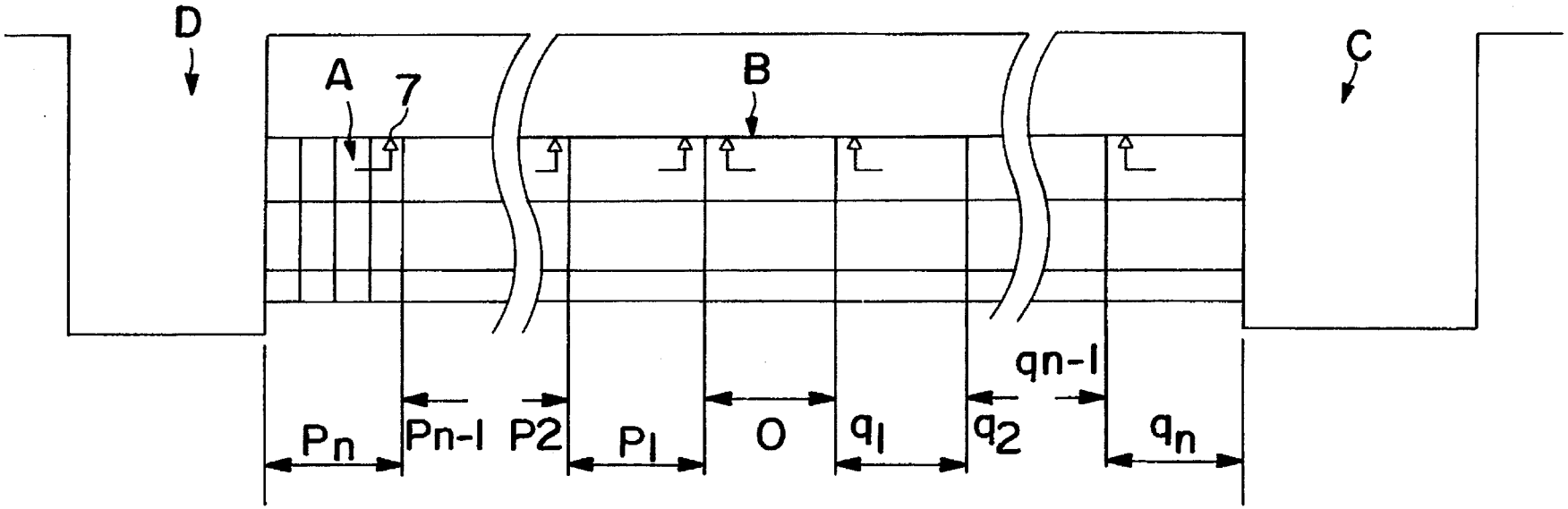
FIG. 7 is a view for showing a state where a conduit to be laid is divided into sections with a given length according to another method.

Then, when conduit B is laid by propelling double-wall pipes A from start vertical shaft C toward an arrival vertical shaft D, a method is explained referring to FIG. 6, in which lubricant is supplied from a side of down stream in the propelling direction.

In the present invention, in the same manner as in the above-mentioned embodiment of the present invention, conduit B to be laid is previously divided into plural sections L1 to Ln.

As shown in the FIG. 6, junction 16 having plural valves 15 to 15*n* corresponding to the number of sections L are mounted in tunneling machine 11. Further, tube 17 which has one end to be connected with junction 16 and has the other end to be connected through hose 13 with pump 14 and the same length as a double-wall pipe is arranged within inner pipe 1. The tube 17 is advanced together with the propulsion of double-wall pipe A. Tube 17 in the double-wall pipe is connected with a new tube 17 in new double-wall pipe A when the double-wall pipe which has been propelled is connected with a new double-wall pipe.

The head double-wall pipe A of the conduit B connected with tunneling machine 11 corresponds to section L1 the farthest from a start vertical shaft C, wherein supply pipes 3(3 to 3*n*) are provided between inner pipes 1 and outer pipes 2 by the number according to the number(*n*) of sections.

When valve 15 an the inner diameter more than 800 mm, a manually operated valve can be used. However, when inner pipe 1 has an inner diameter under the above-mentioned diameter, an electromagnetic valve can be used as valve 15.

When the double-wall to be positioned at the head in section L1 is propelled, supply pipes 3 to 3*n* provided in the double-wall pipes are connected with valves 15 to 15*n* provided in tunneling machine 11, respectively, while tube 17 is connected with junction 16, supply pipes 3 are connected with check valves 4, and an end of supply pipe 3 is closed by a plug. Then, the valve 15 connected with supply pipe 3 is opened, pump 14 is driven so that lubricant is sent through junction 16, the valve 15, and supply pipe 3 to check valve 4, and injected through check valve 15 into a space between the outside of the double-wall pipe and the ground, while double-wall pipe A is propelled. After the head double-wall pipe A has been propelled, the following double-wall pipe A is connected with the double-wall pipe A which has been propelled, wherein all the supply pipes 3*a* to 3*n* except a supply pipe 3 of the double-wall pipe A which has been propelled are connected with supply pipes 3*a* to 3*n* of the following double-wall pipe A, respectively.

After all the double-wall pipes A corresponding to section L1 have propelled, double-wall pipe A to be positioned at the head in section L2 is connected with the double-wall pipe A to be positioned at the backward end in section L1, wherein supply pipes 3*a* to 3*n* of the double-wall pipe A which has been propelled are connected with supply pipe 3*a* to 3*n* of a new double-wall pipe, supply pipe 3*a* is connected with check valve 4*a*, and an end of supply pipe 3*a* is closed by a plug. Then, valve 15*a* connected with supply pipe 3*a* is opened, while tunneling machine 11 and double-wall pipes A which follows tunneling machine 11 are propelled. While propelling double-wall pipes, lubricant is injected from the double-wall pipe A to be positioned at the head in section L1 and from the double-wall pipe A to be positioned at the head in section L2 into a space between the outside of double-wall pipes and the ground.

After all the double-wall pipes A corresponding to section L2 have has been propelled, in the same manner as the above-mentioned embodiment, double-wall pipes A corresponding to the succeeding section L3 to Ln are connected in order, to the double-wall pipe A at the rear in section L2, while supply pipes 3 of the double-wall pipe A which has been propelled are connected with supply pipes 3 of a double-wall pipe which follows the double-wall pipe A which has been propelled, and lubricant is simultaneously injected from the double-wall pipe A to be positioned at the head in each section L.

As above-mentioned, frictional resistance between the outside of double-wall pipes A and the ground can be reduced by simultaneously injecting from double-wall pipes A to be positioned at the head in each section L into a space between the outside of double-wall pipes and the ground so that tunneling machine 11 and double-wall pipes A which follows tunneling machine 11 can be smoothly propelled.

Then, referring to FIGS. 7 to 10, a method of injecting lubricant into a space between the outside of double-wall pipes and the ground is explained. In this method, double-wall pipes A are propelled from start vertical shaft C to an arrival vertical shaft so that conduit B is laid, in sections, which lie on the arrival vertical shaft side. Lubricant is supplied from the downstream side in the propelling direction to double-wall pipe A, while in sections which lie on the start vertical shaft side, lubricant is supplied from the upstream side in the propelling direction to double-wall pipe A.

In the present embodiment, conduit B to be laid is divided into plural sections in the same manner as the above-mentioned embodiments. Among divided sections, a section which is positioned at the center conduit B is designated as section o, sections which are positioned between section o and arrival vertical shaft D are designated as sections p1 to pn, and sections which are positioned between section o and start vertical shaft C are designated as sections q1 to qn.

In sections p1 to pn, in the same manner as the second embodiment, lubricant is supplied from the head double-wall pipe A which follows tunneling machine 11 to check valve 4, and injected through check valve 4 into a space between the outside of double-wall pipes and the ground, while in sections q1 to qn, in the same manner as the first embodiment, lubricant is supplied from the double-wall pipe A which is disposed on the start vertical shaft C side to check valve 4, and injected through check valve 4 into a space between the outside of double-wall pipes A and the ground.

Namely, after tunneling machine 11 provided with junction 16 has been propelled, tunneling machine 11 and the head double-wall pipe A which is a component of the conduit B following tunneling machine 11 are propelled. The double-wall pipe A corresponds to the farthest section pn from start vertical shaft C. Therefore, double-wall pipes A provided with supply pipes 3 the number of which corresponds to the number n of sections between the central section o and arrival vertical shaft D are selectively used as double-wall pipes A, wherein these supply pipes 3 are connected with valves 15 provided in junction 16, respectively. Tube 17 for sending lubricant is inserted within inner pipe 1. One end of tube 17 is connected with junction 16, while the other end of tube 117 is connected through hose 13 with pump 14.

After preparations have been made for propelling of the head double-wall A as above-mentioned, tunneling machine 11 and the head double-wall pipe A are propelled by pipe-jacking machine 12, while lubricant is pumped through hose 13, tube 17, supply pipe 3 to check valve 4 by pump 14, and injected through check valve 4 into a space between the outside of double-wall pipe A and the ground. Then, after the head double-wall pipe A has been propelled, push ring 12*a* of pipe-jacking machine 12 is moved back, then a second double-wall pipe A is put on pipe-jacking machine 12, and a front end of inner pipe 1 of the second double-wall pipe A is welded to the rear end of inner pipe 1 in the head double-wall pipe A.

Figure 8:
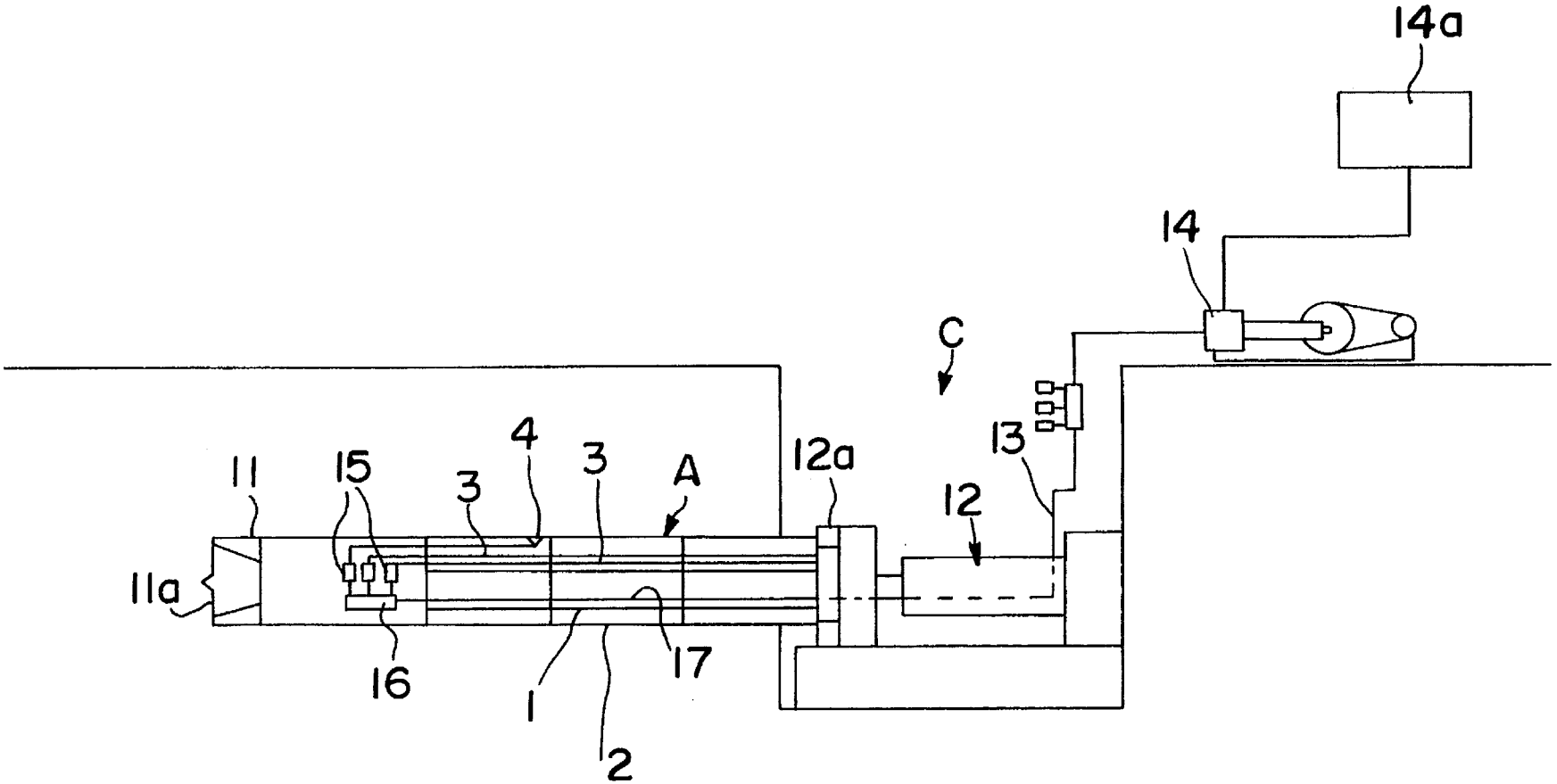
FIG. 8 is a view for showing a state where lubricant is injected into a space between the outside of a double-wall pipe in a section which is the farthest from a start vertical shaft, during the propulsion of double-wall pipes.
Figure 9:
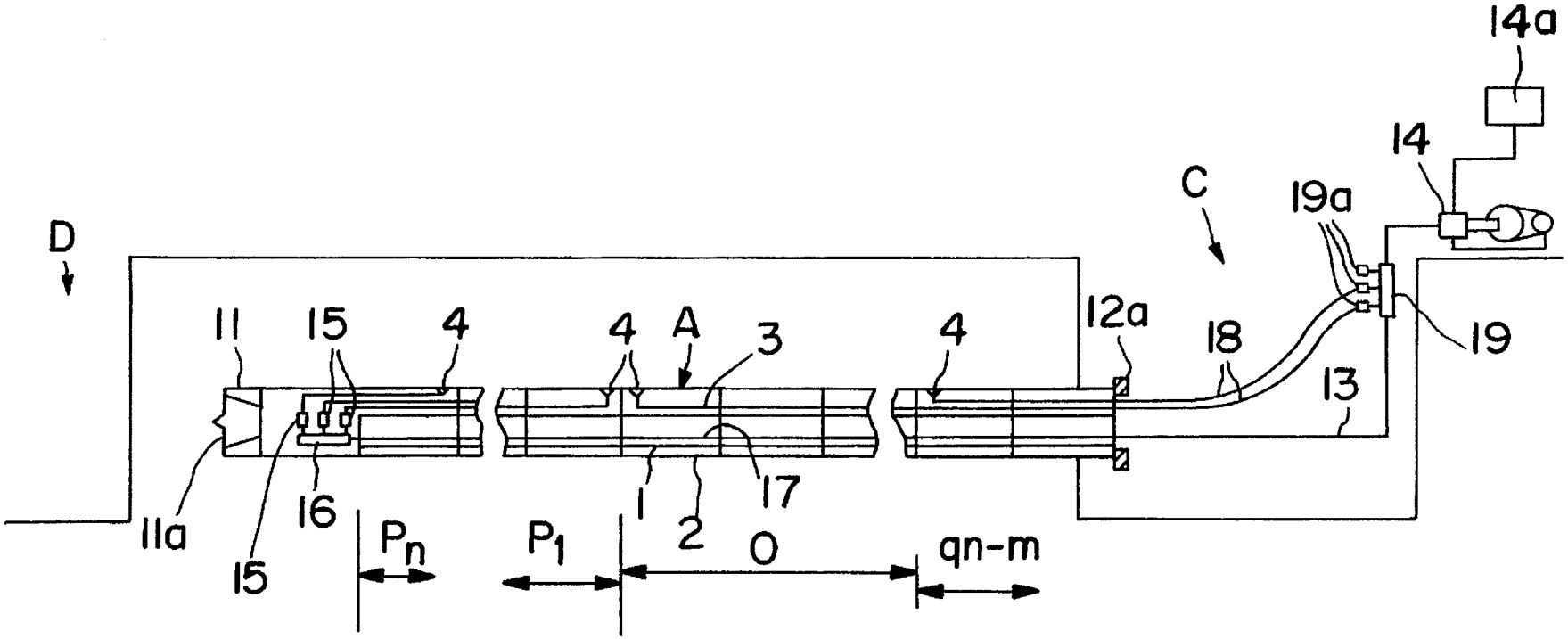
FIG. 9 is a view for showing a state where lubricant is injected into a space between the outside of a double-wall pipe to be positioned in a section which is positioned on a side of the start vertical shaft with respect to a section at about a center of the conduit, during the propulsion of double-wall pipes.

Then, supply pipes 3 of the head double-wall pipe A are connected through a joint with supply pipes 3 of the second double-wall pipe A, a rear end of supply pipe 3 of the second double-wall pipe A is closed by a plug, and a new tube 17 in the head double-wall pipe A is connected with a tube 17 in the second double-wall pipe A, and thereafter push ring 12*a* is brought into contact with the second double-wall pipe A, and tunneling machine 11 and double-wall pipes. A are propelled by pipe-jacking machine 12, while lubricant is injected from only the head double-wall pipe A into a space between the outside of double-wall pipes and the ground-(FIG. 8).

Then, in the same manner as in the case of the second embodiment, double-wall pipes A corresponding to sections pn-1 to p1 are connected in order, to the second double-wall pipe A, and tunneling machine 11 and double-wall pipes A are propelled, while lubricant is injected from double-wall pipes A to be positioned at the head in each section pn to p1 into a space between the outside of double-wall pipes A and the ground.

After all double-wall pipes A corresponding to sections pn to p1 have been propelled as above-mentioned, a new double-wall pipe A, which is to be positioned at the head in section o, is put on pipe-jacking machine 12, wherein double-wall pipe A provided with one supply pipe 3 is selected as the new double-wall pipe. One end of the supply pipe 3 is connected with check valve 4 in the new double-wall pipe A and the other end of the supply pipe 3 is connected with hose 18 arranged in start vertical shaft C double-wall pipes A and the ground. The hose 18 is connected through valves 19*a* with pump 14 provided in distributor 19.

After the preparation for propelling double-wall pipes A corresponding to the central section o the double-wall pipes A have been propelled in the same manner as above-mentioned, wherein lubricant is injected simultaneously from double-wall pipes A to be positioned at the head in sections pn to p1, and o, into a space between the outside of double-wall pipes and the ground. When the propulsion of double-wall pipe A corresponding to section o has been finished a new double-wall pipe A corresponding to section q1 is put on pipe-jacking machine 12, wherein double-wall pipe A provided with two supply pipes 3 are selected as the new double-wall pipe, and propelled. Thereafter, in the same manner as the first embodiment, double-wall pipes A corresponding to sections q1 to qn are selected and propelled, while lubricant is simultaneously injected from double-wall pipes A which is to be positioned at the head in each section q1 to qn so that the propulsion of double-wall pipes are easily made.

As above-mentioned, in the present embodiment, even in case of supply pipes 3 connected with each other having the longest total length, a total length of the connected supply pipes is half the length of the conduit B, and the number of supply pipes needed for supplying lubricant to check valves is half as compared to a case where lubricant is supplied from only one vertical shaft side. Therefore, line resistance which is generated when lubricant is sent through supply pipes 3 can be reduced sharply, and the diameter of supply pipes 3 can be made small. As supply pipes can be made thin and the number of supply pipes can be reduced, the diameter of outer pipes 2 can be made small, while the diameter of inner pipe 1 is maintained at a given value. Accordingly, the tunneling machine can be made compact and the amount of excavated earth and soil can be reduced.

Figure 10:
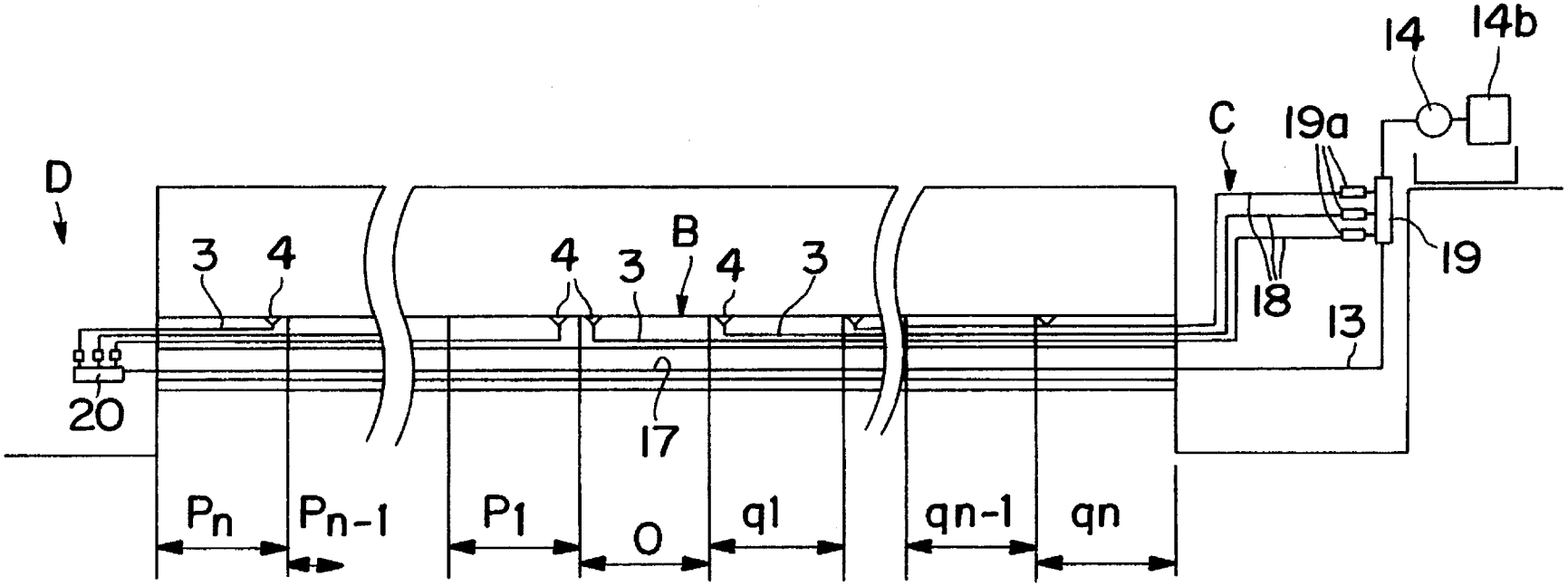
FIG. 10 is a view for showing the construction of a double-wall pipe applied in the present invention.

Then, a method of injecting back-filling material as filler into a space formed between the outside of the conduit B laid between start vertical shaft C and arrival vertical shaft D and the ground is explained, referring to FIG. 10.

After conduit B has been laid, tunneling machine 11 is disconnected from the head double-wall pipe A and taken out from arrival vertical shaft D. Thereafter, distributor 20 is connected with tube 17, and with supply pipes 3 corresponding to sections p1 to pn which are positioned on the arrival vertical shaft side of the conduit B. Tank 14*b* in which back-filling material is put is connected with pump 14. Supply pipes 3 of double-wall pipes corresponding to sections q1 to qn which are positioned on the start vertical shaft side are connected with distributor 19 provided in start vertical shaft C in order to maintain the state where lubricant is supplied to check valves 4.

When pump 14 is driven under the above-mentioned condition, back-filling material in tank 14*b* is sent through tube 17, distributor 20, and supply pipe 3 to check valves 4 in sections p which are positioned one the arrival vertical shaft side to check valves 4 in sections p Which are positioned on the arrival vertical shaft side, and injected through the check valve 4 into a space between the outside of double-wall pipes and the ground and at the same time back-filling materials is sent through hose 18 and supply pipes 3 to check valves 4 in the central section o and each of sections q which are positioned on the start vertical shaft side, and injected through check valves 4 in the central section o and each of sections q which are positioned on the start vertical shaft side into a space between the outside of double-wall pipes and the ground.

As above-mentioned, back-filling material can be injected from check valves 4 in the respective sections of the conduit B which has been laid simultaneously by which the time needed for filling a space between the outside of double-wall pipes and the ground with back-filling material can be reduced. In order to inject back-filling material into a space between the outside of double-wall pipes and the ground, pumps may be provided in respective vertical shafts C, D, respectively so that back-filling material can be supplied simultaneously to check valves 4 in sections p which are positioned on the arrival vertical shaft side, section o and sections q which are positioned on the start vertical shaft side from different pumps.

Figure 11B:
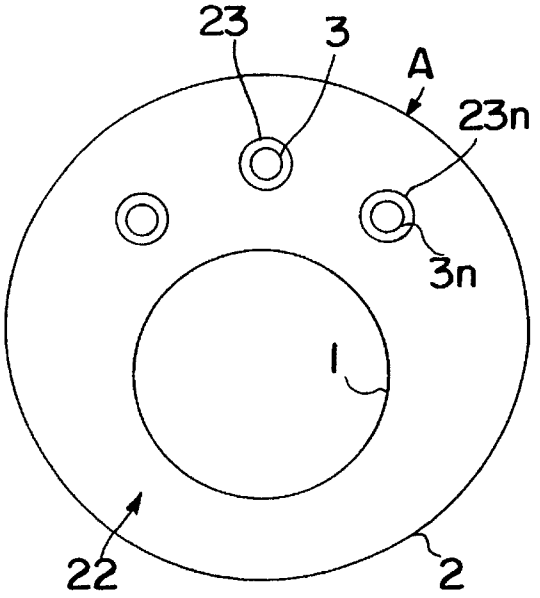
FIG. 11(*a*) is a view for showing a state where a space between the outside of double-wall pipes and the ground is filled with filler, after having laid a conduit.
Figure 11A:
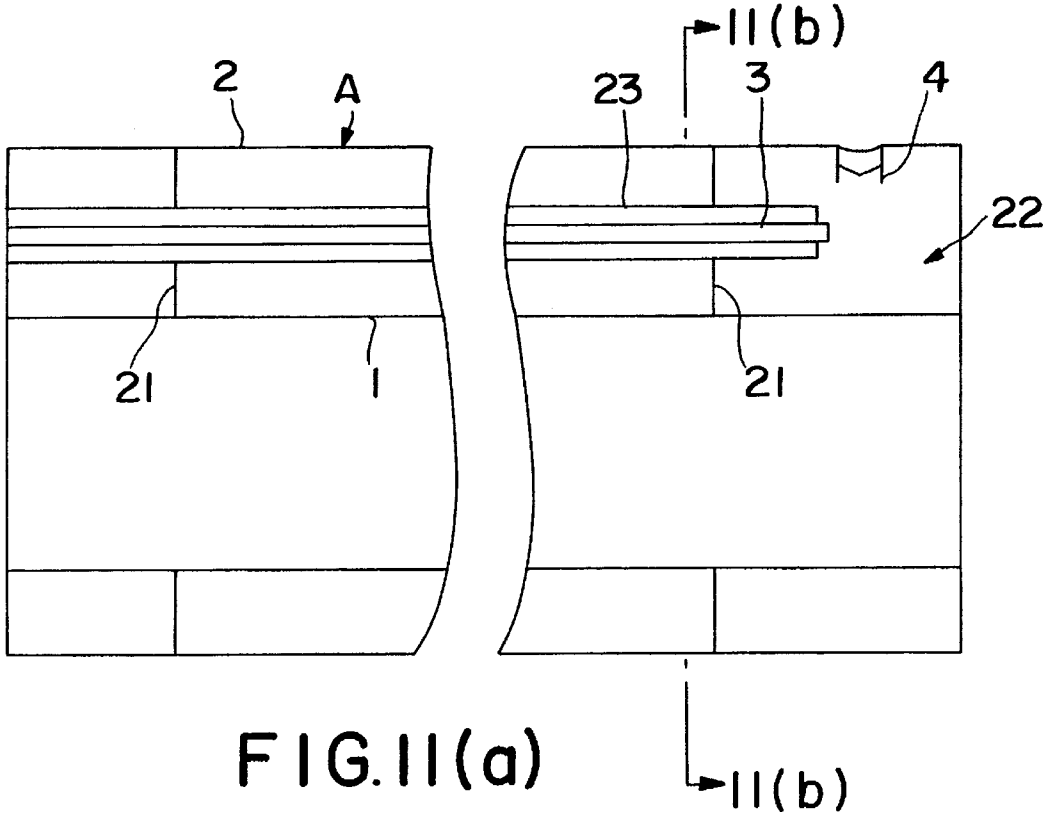
Figure 12:
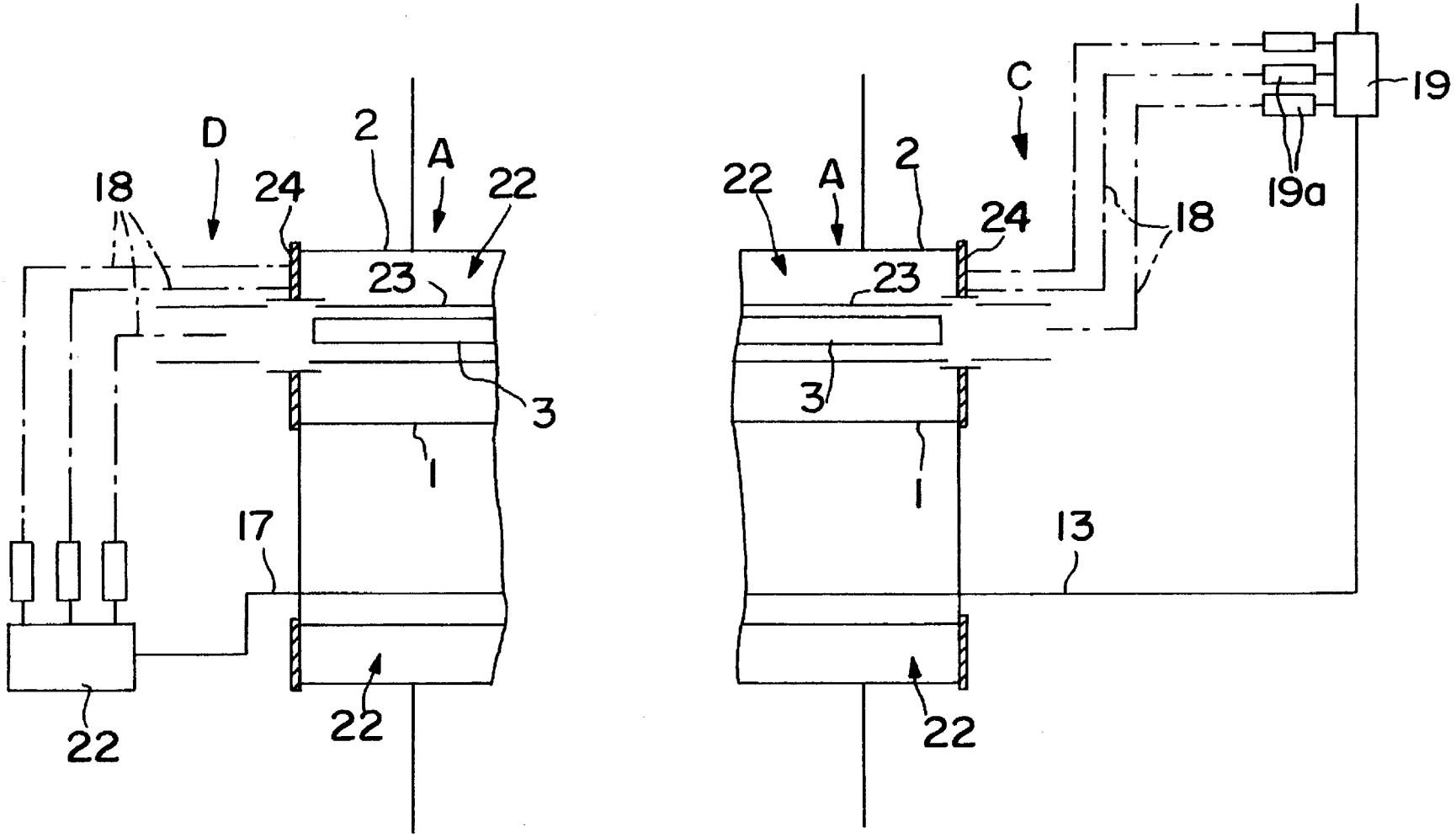

Then, a method of injecting inside-filling material as filler into a space formed between inner pipe 1 and outer pipe 2 of double-wall pipe A is explained, referring to FIGS. 11(*a*) and(*b*) and 12.

First, the construction of double-wall pipe A used when a method according to the present invention is carried out is explained, referring to FIG. 11(*a*) and FIG. 11(*b*). Inner pipe 1 and outer pipe 2 are arranged so as to be relatively movable in the longitudinal direction through brackets 21 so that a space 22 is formed between inner pipe 1 and outer pipe 2. Between inner pipe 1 and outer pipe 2, sheath pipes 23 are provided, in which supply pipes 3 are inserted, wherein a second double-wall pipe is formed of the sheath pipes 23 and the supply pipes 3. End portions of sheath pipes 23 are opened and projected into space 22 formed between inner pipe 1 and outer pipe 2.

As double-wall pipes A, double-wall pipes provided with one sheath pipe 23 and one supply pipe 3, and double-wall pipes provided with 2 to n of sheath pipes and 2 to n of supply pipes are provided, wherein the second double-wall pipe composed of sheath pipe 23 and supply pipe 3 is different from double-wall pipe composed of inner pipe and outer pipe in the function, and the structure composed of sheath pipe 23 and supply pipe 3 is merely called as the second double-wall pipe from the structural analogy. Therefore, in the following explanation, sheath pipe 23, and supply pipes 3 are handled as being independent.

After conduit B has been laid between start vertical shaft C and arrival vertical shaft D, space 22 opening toward arrival vertical shaft D of the conduit B and toward start vertical shaft C is sealed off by sealing member 24. Sheath pipes 23 of double-wall pipes A corresponding to the respective sections p opening toward arrival shaft D are connected through hoses 18 with distributing member 20, while sheath pipes 23 of double-wall pipes A corresponding to the respective sections q opening toward start vertical shaft C are connected through hoses 18 with distributer 19 connected with a pump.

After sheath pipes 23 corresponding to the respective sections have been connected with a pump as above-mentioned, the pump is driven so that inside-filling material is supplied through tube 17, distributor 20, and sheath pipes 23 to double-wall pipes A corresponding to check valves 4 in the respective sections p which are positioned on the arrival vertical shaft side and injected through openings of sheath pipes 23 into space 22, while inside-filling material is supplied through hoses 18, and sheath pipes 23 to double-wall pipes A corresponding to check valves 4 in the respective sections q which are positioned on the start vertical shaft side and injected through openings of sheath pipes 23 into space 22.

Accordingly, inside-filling material can be injected simultaneously from the start vertical shaft C side and from the arrival vertical shaft D side in space 22 formed between inner pipe 1 and outer pipe 2, so that the operation of injecting inside-filling material can be carried out easily and in less time.

What is claimed is:

1. A method of injecting lubricant into a space between the outside of double-wall pipes and the ground in the propelling process of double-wall pipes comprising the steps of:

preparing double-wall pipes each of which comprises an inner pipe and an outer pipe which has at least one supply pipe for lubricant provided between the inner pipe and the outer pipe, and a discharge port formed in the outer pipe;

propelling a tunneling machine and a double-wall pipe following the tunneling machine from a start vertical shaft toward an arrival vertical shaft by a pipe-jacking machine;

connecting a supply pipe of double-wall pipe which has been propelled with a supply pipe of a new double-wall pipe;

connecting the supply pipe of the new double-wall pipe with a lubricant feeder;

thereafter propelling the tunneling machine and the double-wall pipes following the tunneling machine by the pipe-jacking machine while lubricant is pumped through the supply pipes to the discharge port by the lubricant feeder and injected through the discharge port into a space between the outside of the double-wall pipes and the ground;

wherein a new double-wall pipe is connected with the double-wall pipe which has been propelled, and with the lubricant feed, the lubricant is supplied from an upstream side in a propelling direction to discharge ports of double-wall pipes.

2. A method as claimed in claim 1 wherein various kinds of double-wall pipes provided with different number of the supply pipes between the inner pipes and the outer pipes are prepared, a scheduled line along which a conduit is to be laid is divided into some sections each having a given length, a double-wall pipe having the smallest number of supply pipes is chosen for the farthest section from the start vertical shaft, a double-wall pipe having supply pipes which number is at least one more than the smallest number of the supply pipes is chosen for a section adjacent to the farthest section on the start vertical shaft side, and so forth double-wall pipes having supply pipes which number is at least one more than the number of supply pipes in the double-wall pipe adjacent thereto on the arrival vertical shaft side are chosen for the respective sections in the direction from the arrival vertical shaft to the start vertical shaft, and the chosen double-wall pipes are arranged in the order of increasing the number of supply pipes from the arrival vertical shaft toward the start vertical shaft and propelled following the tunneling machine.

3. A method as claimed in claim 2 wherein junction member is provided in the lubricant feeder in order that lubricant discharged from the lubricant feeder is sent to plural lines, and the supply pipes in the double-wall pipes are connected with lubricant feeding holes of the junction member.

4. A method as claimed in claim 1 wherein double-wall pipes provided with plural supply pipes between the inner pipes and the outer pipes are prepared, a scheduled line along which a conduit is to be laid is divided into some sections each having a given length, one supply pipe chosen from the plural supply pipes in each double-wall pipes is used for distributing lubricant to the double-wall pipes, while the double-wall pipes corresponding to the farthest section from the start vertical shaft are propelled, the chosen supply pipe and at least one supply pipe chosen from the rest of the plural supply pipes is used for distributing lubricant to the double-wall pipes, while double-wall pipes corresponding to the section adjacent to the farthest section on the start vertical shaft side are propelled, and so forth the number of supply pipes used in the respective sections increases by at least one more than the number of supply pipes used in the section adjacent thereto on the arrival vertical shaft side.

5. A method as claimed in claim 4 wherein junction member is provided in the lubricant feeder in order that lubricant discharged from the lubricant feeder is sent to plural lines, and the supply pipes in the double-wall pipes are connected with lubricant feeding holes of the junction member.

6. A method as claimed in claim 1, wherein a first double-wall pipe immediately following the tunneling machine is connected with the lubricant feeder by which lubricant is supplied to the supply pipes of said first double-wall pipe from the downstream side in the propelling direction.

7. A method as claimed in claim 6 wherein various kinds of double-wall pipes provided with different number of the supply pipes between the inner pipes and the outer pipes, respectively, are prepared, a scheduled line along which a conduit is to be laid is divided into some sections each having a given length, a double-wall pipes having the largest number of supply pipes are chosen for the farthest section from the start vertical shaft, double-wall pipes having supply pipes which number is at least one less than the largest number of the supply pipes is chosen for a section adjacent to the farthest section on the start vertical shaft side, and so forth a double-wall pipe having supply pipes which number is at least one less than the number of supply pipes of double-wall pipe adjacent thereto on the arrival vertical shaft side are chosen for the respective sections in the direction from the arrival vertical shaft side to the start vertical shaft side, and the chosen double-wall pipes are arranged in the order of decreasing the number of supply pipes from the arrival vertical shaft toward the start vertical shaft following the tunneling machine.

8. A method as claimed in claim 7 wherein junction member is provided in the lubricant feeder in order that lubricant discharged from the lubricant feeder is sent to plural lines, and the supply pipes in the double-wall pipes are connected with lubricant feeding holes of the junction member.

9. A method as claimed in claim 6 wherein double-wall pipes provided with plural supply pipes between the inner pipes and the outer pipes are prepared, a scheduled line along which a conduit is to be laid is divided into sections each having a given length, supply pipes chosen from the plural supply pipes in each double-wall pipes which number is equal to the number of the sections are used for distributing lubricant, while double-wall pipes corresponding to the farthest section from the start vertical shaft are propelled, the supply pipes except at least one double-wall pipe of the chosen supply pipes are used for distributing lubricant, while double-wall pipes corresponding to the section adjacent to the farthest section from the start vertical shaft are propelled, and so forth the number of supply pipes used in the respective sections, while double-wall pipes corresponding to the respective sections are propelled, decreases by at least one more than the number of supply pipes used in the section thereto on the arrival vertical shaft side.

10. A method as claimed in claim 9 wherein junction member is provided in the lubricant feeder in order that lubricant discharged from the lubricant feeder is sent to plural lines, and the supply pipes in double-wall pipes are connected with lubricant feeding holes of the junction member.

11. A method as claimed in claim 2 wherein a scheduled line along which a conduit is to be laid is divided into two zones, while double-wall pipes which are to be positioned on the arrival vertical shaft side of the center of the conduit are propelled, lubricant is injected through supply pipes of the head double-wall pipes following a tunneling machine into a space between the outside of double-wall pipes and the ground, and while double-wall pipes which are to be positioned on the start vertical shaft side of the center of the conduit are propelled, lubricant is injected through supply pipes of the rearmost double-wall pipe arranged of double-wall pipes following tunneling machine into a space between the outside of double-wall pipes and the ground.

12. A method as claimed in claim 11 wherein various kinds of double-wall pipes provided with different number of the supply pipes between the inner pipes and the outer pipes are prepared, a scheduled line along which a conduit is to be laid is divided into some sections each having a given length, a double-wall pipe having the smallest number of double-wall pipes are chosen for the central section of the scheduled line, double-wall pipes having supply pipes which number is at least one more than the above-mentioned smallest number are chosen for a section adjacent to the central section on the start vertical shaft side of the central section and against a section adjacent to the central section on the start vertical shaft side of the central section, and so forth double-wall pipes provided with supply pipes which number is by at least one more than the number of supply pipes used in the section thereto on the arrival vertical section are chosen in the direction of from the arrival vertical shaft to the start vertical shaft, a tunneling machine and the chosen double-wall pipes arranged in the order of decreasing the number of supply pipes following the tunneling machine are propelled, the double-wall pipe provided with the smallest number of supply pipes for the central section is propelled, thereafter the double-wall pipes for against sections between the central section and the start vertical section are propelled in the order of increasing supply pipes of the respective double-wall pipes.

13. A method of injecting lubricant and filler in the propelling process of first double-wall pipes wherein within a space formed between an inner pipe and an outer pipe is a second double-wall pipe having an inner sheath pipe opening toward the space wherein lubricant is supplied to the inside of the sheath pipe, while a supply with which a discharge port for discharging lubricant to the outside of the first double-wall pipe is connected is inserted thereby forming the second double-wall pipe, the first double-wall pipes composed of inner pipes and outer pipes are laid between the start vertical shaft and the arrival vertical shaft, thereafter filler is supplied from the start vertical shaft side and from the arrival vertical shaft side to the sheath pipe so that the space between the inner pipe and the outer pipe is filled with filler.

* * * * *